US006378629B1

(12) United States Patent
Baird

(10) Patent No.: US 6,378,629 B1
(45) Date of Patent: Apr. 30, 2002

(54) BORING APPARATUS

(75) Inventor: Billy Carr Baird, Sturgis, KY (US)

(73) Assignee: Saturn Machine & Welding Co., Inc., Sturgis, KY (US)

( * ) Notice: Subject to any disclaimer, the term of this patent is extended or adjusted under 35 U.S.C. 154(b) by 0 days.

(21) Appl. No.: 09/643,306

(22) Filed: Aug. 21, 2000

(51) Int. Cl.[7] ..... E21B 7/08

(52) U.S. Cl. ..... 175/75; 175/76; 175/77; 175/78; 175/81; 175/82; 175/99; 175/107; 175/262; 175/288; 175/292; 175/325.3

(58) Field of Search ..... 175/62, 73–78, 175/81, 82, 92, 97, 99, 101, 107, 262, 288, 292, 325.3

(56) References Cited

U.S. PATENT DOCUMENTS

| | | | | |
|---|---|---|---|---|
| 1,367,042 | A | | 2/1921 | Granville |
| 1,485,615 | A | | 3/1924 | Jones |
| 1,733,311 | A | | 10/1929 | McNeill |
| 2,065,436 | A | | 12/1936 | Ervin |
| 2,251,916 | A | | 8/1941 | Cross |
| 2,271,005 | A | | 1/1942 | Grebe |
| 2,345,816 | A | | 4/1944 | Hays |
| 2,521,976 | A | | 9/1950 | Hays |
| 2,608,384 | A | | 8/1952 | Alexander |
| 3,191,697 | A | | 6/1965 | Haines |
| 3,262,508 | A | | 7/1966 | Price |
| 3,536,151 | A | | 10/1970 | Aarup |
| 3,670,831 | A | | 6/1972 | Winter, Jr. et al |
| 3,802,520 | A | * | 4/1974 | Whitman |
| 3,838,736 | A | | 10/1974 | Driver |
| 3,840,079 | A | | 10/1974 | Williamson |
| 3,853,185 | A | | 12/1974 | Dahl et al. |
| 3,873,156 | A | | 3/1975 | Jacoby |
| 3,958,649 | A | | 5/1976 | Bull et al. |
| 4,007,797 | A | | 2/1977 | Jeter |
| 4,168,752 | A | | 9/1979 | Sabol |
| 4,185,705 | A | | 1/1980 | Bullard |
| 4,317,492 | A | | 3/1982 | Summers et al. |
| 4,365,676 | A | | 12/1982 | Boyadjieff et al. |
| 4,368,786 | A | | 1/1983 | Cousins |
| 4,397,360 | A | | 8/1983 | Schmidt |
| 4,445,574 | A | | 5/1984 | Vann |
| 4,457,370 | A | * | 7/1984 | Wittrisch |
| 4,497,381 | A | | 2/1985 | Dickinson, III et al. |
| 4,526,242 | A | | 7/1985 | Mathieii et al. |
| 4,527,639 | A | | 7/1985 | Dickinson, III et al. |

(List continued on next page.)

FOREIGN PATENT DOCUMENTS

| | | |
|---|---|---|
| DE | 0485867 | 10/1929 |
| FR | 0702530 | 4/1931 |
| FR | 1289136 | 2/1962 |
| FR | 2091931 | 1/1972 |
| FR | 2232669 | 3/1975 |

*Primary Examiner*—Roger Schoeppel
(74) *Attorney, Agent, or Firm*—Wood, Herron & Evans, L.L.P.

(57) ABSTRACT

Apparatus for boring a hole from an inside of a tube outwardly perpendicular to a longitudinal axis of the tube comprises a drill shoe having a longitudinal axis and being positionable in the tube, the shoe having an inlet, an outlet perpendicular to the shoe longitudinal axis and a passageway connecting the inlet and outlet, a torsional load transmitting element having no torsional flexibility in relation to its bending flexibility, having a longitudinal axis and being disposed in the passageway, the torsional load transmitting element being movable relative to itself with no resistance about first and second perpendicular axes both of which are perpendicular to the longitudinal axis of the torsional load transmitting element, a hole saw connected to one end of the torsional load transmitting element and a motor rotatably connected to the other end of the torsional load transmitting element. Rotation of the torsional load transmitting element by the motor rotates the hole saw to bore through the tube from the inside of the tube outwardly perpendicular to the longitudinal axis of the tube.

19 Claims, 2 Drawing Sheets

U.S. PATENT DOCUMENTS

| | | | | |
|---|---|---|---|---|
| 4,533,182 | A | | 8/1985 | Richards |
| 4,570,709 | A | * | 2/1986 | Wittrisch |
| 4,589,499 | A | | 5/1986 | Behrens |
| 4,601,353 | A | | 7/1986 | Schuh et al. |
| 4,631,136 | A | | 12/1986 | Jones, III |
| 4,640,362 | A | | 2/1987 | Schellstede |
| 4,648,454 | A | * | 3/1987 | Yarnell |
| 4,763,734 | A | | 8/1988 | Dickinson et al. |
| 4,832,143 | A | | 5/1989 | Kaalstad et al. |
| 4,832,552 | A | | 5/1989 | Skelly |
| 4,836,611 | A | | 6/1989 | El-Saie |
| 4,848,486 | A | | 7/1989 | Bodine |
| 4,850,440 | A | | 7/1989 | Smet |
| 4,854,400 | A | | 8/1989 | Simpson |
| 4,880,067 | A | | 11/1989 | Jelsma |
| 4,890,681 | A | | 1/1990 | Skelly |
| 4,928,757 | A | | 5/1990 | Schellstede et al. |
| RE33,660 | E | | 8/1991 | Jelsma |
| 5,088,553 | A | * | 2/1992 | Ralston et al. |
| 5,090,496 | A | | 2/1992 | Walker |
| 5,113,953 | A | | 5/1992 | Noble |
| 5,148,880 | A | | 9/1992 | Lee et al. |
| 5,165,491 | A | | 11/1992 | Wilson |
| 5,180,016 | A | * | 1/1993 | Ross et al. |
| 5,183,111 | A | | 2/1993 | Schellstede |
| 5,373,906 | A | | 12/1994 | Baddick |
| 5,425,429 | A | | 6/1995 | Thompson |
| 5,439,066 | A | | 8/1995 | Gipson |
| 5,622,231 | A | | 4/1997 | Thompson |
| 5,800,099 | A | * | 9/1998 | Cooper |
| 6,125,949 | A | | 10/2000 | Landers |
| 6,263,984 | B1 | * | 7/2001 | Buckman |

* cited by examiner

BORING APPARATUS

FIELD OF THE INVENTION

This invention relates broadly to the boring of a hole through the wall of a tube from the inside of the tube outwardly perpendicular to a longitudinal axis of the tube. More particularly, this invention relates to drilling through an oil or gas well casing perpendicular to the longitudinal axis of the casing and laterally into the earth strata surrounding the well casing.

BACKGROUND OF THE INVENTION

Oil and gas wells are drilled vertically down into the earth strata with the use of rotary drilling equipment. A tube known as a casing is placed down into the well after it is drilled. The casing is usually of made of mild steel and is in the neighborhood of 4.5 inches to 8 inches in external diameter (4 inches in internal diameter and up) and defines the cross-sectional area of the well for transportation of the oil and gas upwardly to the earth surface. However, these vertically extending wells are only useful for removing oil and gas from the terminating downward end of the well. Thus, not all of the oil and gas in the pockets or formations in the surrounding earth strata, at the location of the well depth, can be removed. Therefore, it is necessary to either make additional vertical drillings parallel and close to the first well, which is costly and time consuming, or to provide some means to extend the original well in a radial direction relative to the vertical longitudinal axis of the casing horizontally into the surrounding earth strata.

The most common means for horizontal extension of the well has been to drill angularly through the well casing at a first 45° angle for a short distance and then to turn the drill and drill at a second 45° angle thereby making a full 90° angular or horizontal cut from the vertically extending well. These horizontal drills have proved useful for extending the well horizontally but have proved to be relatively expensive.

Another solution to the problem is disclosed in U.S. Pat. Nos. 5,413,184 and 5,853,056, both of which are hereby incorporated by reference herein as if fully set forth in their entirety. In these patents there is disclosed an apparatus comprising an elbow, a flexible shaft or so-called "flex cable" and a ball cutter attached to the end of the flexible shaft. The elbow is positioned in the well casing, and the ball cutter and flexible shaft are passed through the elbow, turning 90°. A motor rotates the flexible shaft to bore a hole in the well casing and surrounding earth strata with the ball cutter. The flexible shaft and ball cutter are then removed and a flexible tube with a nozzle on the end thereof is passed down the well casing, through the elbow and is directed out of the casing through the hole therein. Water pumped through the flexible tube exits the nozzle at high speed and bores further horizontally into the earth strata.

Prototype testing of the device disclosed in U.S. Pat. Nos. 5,413,184 and 5,853,056 has proven less than satisfactory. In particular, a number of problems plague the device disclosed in U.S. Pat. Nos. 5,413,184 and 5,853,056. For example, the disclosed ball cutter is inefficient at best and ineffective at worst in cutting through the well casing. The inherent spherical geometry of a ball cutter causes it "walk" or "chatter" during rotation as it attempts to bore through the well casing which greatly increases the amount of time required to bore through the casing. Ball cutters are best utilized for deburring, and/or cutting a radius in an existing hole or slot for example, and are simply not suitable for drilling holes.

Another problem is the torsional flexibility of the flexible shaft or flex cable. Rather than transmitting rotational displacement to the ball cutter at 100% efficiency the flex cable tends to "wind up" or exhibit "backlash," thus reducing the already inefficient cutting efficiency of the ball cutter even more.

Yet another problem is the tendency of the elbow to back away from the hole in the casing during drilling with the ball cutter. Such backing away causes the elbow outlet to become misaligned with the hole in the casing thereby preventing smooth introduction of the nozzle and flexible tube into the hole in the casing.

Still another problem is the large amount of torsional friction generated between the elbow passageway and the flex cable which of course increases the horsepower requirements of the motor required to rotate the flex cable. The addition of balls, separated by springs, to the flex cable, in an effort to alleviate the resistance of the apparatus to being rotated, has not remedied this problem.

A further problem is the closed nature of the apparatus of U.S. Pat. Nos. 5,413,184 and 5,853,056, which prevents its being taken apart, inspected, cleaned and repaired as needed.

SUMMARY OF THE INVENTION

The present invention overcomes the deficiencies of the apparatus disclosed in U.S. Pat. Nos. 5,413,184 and 5,853,056. The present invention is apparatus for boring a hole from an inside of a tube outwardly perpendicular to a longitudinal axis of the tube. The apparatus comprises a drill shoe having a longitudinal axis and being positionable in the tube, the shoe having an inlet, an outlet perpendicular to the shoe longitudinal axis and a passageway connecting the inlet and outlet, a torsional load transmitting element having no torsional flexibility in relation to its bending flexibility, having a longitudinal axis and being disposed in the passageway, the torsional load transmitting element being movable relative to itself about first and second perpendicular axes both of which are perpendicular to the longitudinal axis of the torsional load transmitting element, a hole saw connected to one end of the torsional load transmitting element and a motor rotatably connected to the other end of the torsional load transmitting element. Rotation of the torsional load transmitting element by the motor rotates the hole saw to bore through the tube from the inside of the tube outwardly perpendicular to the longitudinal axis of the tube.

Preferably the torsional load transmitting element is freely movable relative to itself about the first and second perpendicular axes. Further preferably the torsional load transmitting element is pivotable relative to itself about the first and second perpendicular axes. Still further preferably the torsional load transmitting element is freely pivotable relative to itself about the first and second perpendicular axes.

The torsional load transmitting element is preferably a plurality of interconnected universal joints having a longitudinal axis and being disposed in the passageway, adjacent ones of the universal joints being pivotable relative to one another about first and second perpendicular axes both of which are perpendicular to the longitudinal axis of the plurality of interconnected universal joints. Adjacent ones of the universal joints are preferably pivotable relative to one another by at least about 35°.

The apparatus may further comprise a drill bit connected to the torsional load transmitting element centrally of the hole saw.

The apparatus may further comprise a biasing element mounted to the shoe and adapted to bias the outlet of the shoe against the tube.

The apparatus may further comprise a detent mechanism operable between the shoe and the motor to prevent the motor from rotating relative to the shoe.

The drill shoe is preferably fabricated in halves.

The tube is preferably a well casing, for example an oil well casing or a gas well casing.

These and other advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF THE INVENTION

Figure 1:
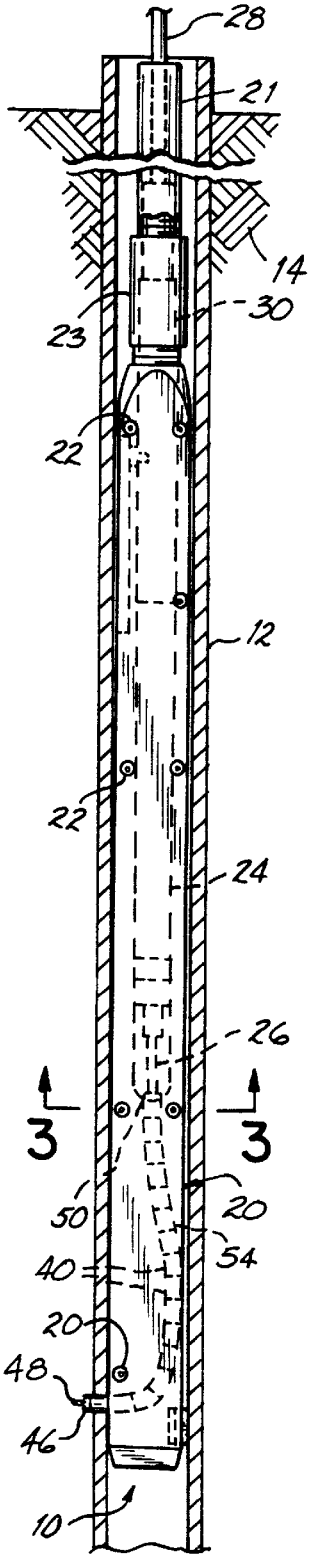
FIG. 1 is a cross-sectional view of the boring apparatus of the present invention.

Referring first to FIG. 1, there is illustrated a boring apparatus 10 according to the principles of the present invention. Boring apparatus 10 is shown positioned inside a well casing 12 in the earth strata 14. Boring apparatus 10 of the present invention includes a hollow carbon steel drill shoe 20. Drill shoe 20 has a longitudinal axis which, when inserted into casing 12, is generally parallel to a longitudinal axis of the well casing 12. Drill shoe 20 is preferably fabricated in halves 20*a* and 20*b*, the halves being securable together via bolts 22. Fabricating the drill shoe 20 in halves as disclosed facilitates the disassembly, inspection, cleaning and repair of the drill shoe 20 all of which are impossible in the apparatus of U.S. Pat. Nos. 5,413,184 and 5,853,056. Drill shoe 20 is connected to a 2 inch diameter hollow steel tube 21, via threaded coupling 23, which tube 21 is utilized to lower drill shoe 20 down into casing 12. Shown already positioned within the drill shoe 20 is a fluid motor 24. Fluid motor 24 includes a rotating output shaft 26. A ½ inch in diameter stainless steel liquid supply tube 28 is operably connected to the fluid motor 24 via coupling 30. Liquid is pumped from a liquid reservoir (not shown) through tube 28 to drive motor 24 to thereby rotate the motor output shaft 26.

Figure 2:
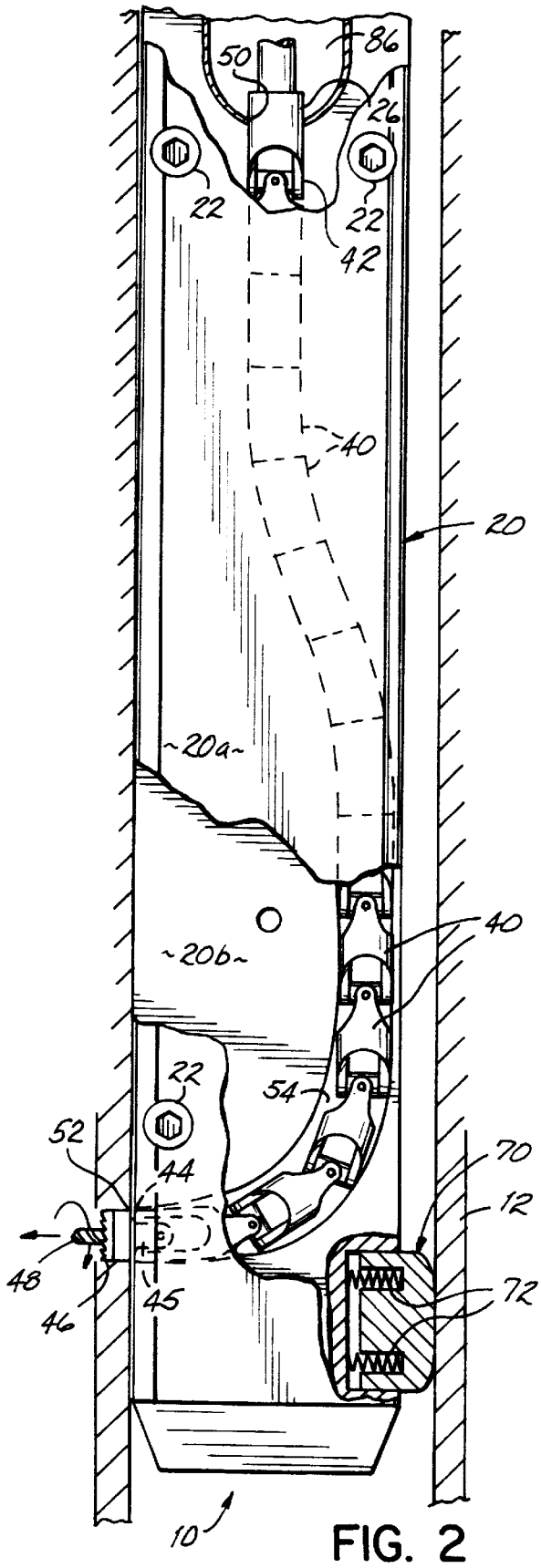
FIG. 2 is an enlarged partial cross-sectional view of the lower portion of the boring apparatus of FIG. 1.

Referring now to FIG. 2, there it will be seen that a plurality of interconnected universal joints 40 has a first end 42 connected to the output shaft 26 of the fluid motor 24 and a second end 44 which has connected thereto a hole saw/pilot drill bit arbor 45. A hole saw 46 is connected to the arbor 45, as is a pilot drill bit 48. Hole saw 46 is a cylindrical saw which, when used to saw through a thickness of material, removes a plug of material within the diameter of the hole saw itself. Drill bit 48 is a so-called "pilot" drill bit in that it is protrudes slightly beyond the saw teeth of hole saw 46 and during initial rotation drills a pilot hole in the wall of the casing 12.

At the lower end of the hollow drill shoe 20 there is an inlet 50, an outlet 52 and a passageway 54 interconnecting the inlet 50 and outlet 52. The longitudinal axis of the outlet 52 is perpendicular to the longitudinal axis of the drill shoe 20. Preferably the longitudinal axis of the inlet 50 is parallel to the longitudinal axis of the drill shoe 20.

Figure 3:
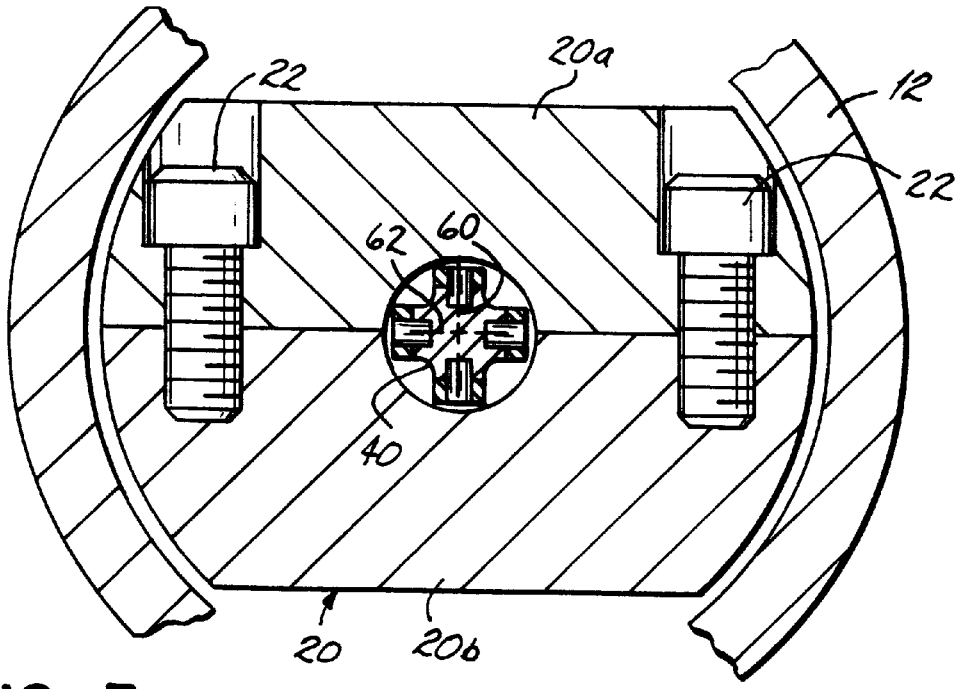
FIG. 3 is a cross-sectional view taken along line 3—3 of FIG. 1.

As is shown in FIG. 3, adjacent ones of the universal joints 40 are preferably pivotable at least about 35°, with preferably little or no resistance, relative to one another about first 60 and second 62 perpendicular axes, both of which axes 60 and 62 are perpendicular to the longitudinal axis of the plurality of interconnected universal joints 40. The interconnected universal joints 40 have a very high torsional stiffness and hence very little or no torsional flexibility, especially in relation to the bending flexibility of the interconnected universal joints 40, which essentially exhibit no resistance to bending about the axes 60 and 62. Thus, the plurality of interconnected universal joints 40 do not exhibit the "wind up" and "backlash" associated with the apparatus disclosed in U.S. Pat. Nos. 5,413,184 and 5,853,056, and additionally, exhibit very little torsional friction or resistance to rotation by the motor 24 and output shaft 26 again unlike the apparatus of U.S. Pat. Nos. 5,413,184 and 5,853,056.

Referring back to FIG. 2, at the lower end of shoe 20 there is illustrated a biasing element 70 which is spring biased relative to the drill shoe 20 via compression springs 72. The biasing element 70 biases the outlet 52 of the drill shoe 20 against the casing 12, thereby increasing the efficiency of the hole saw 46 and eliminating misalignment of the output 52 with respect to the hole drilled in the casing 12 exhibited by the apparatus of U.S. Pat. Nos. 5,413,184 and 5,853,056 thus facilitating insertion of a liquid supply tube and nozzle therethrough.

Figure 4:
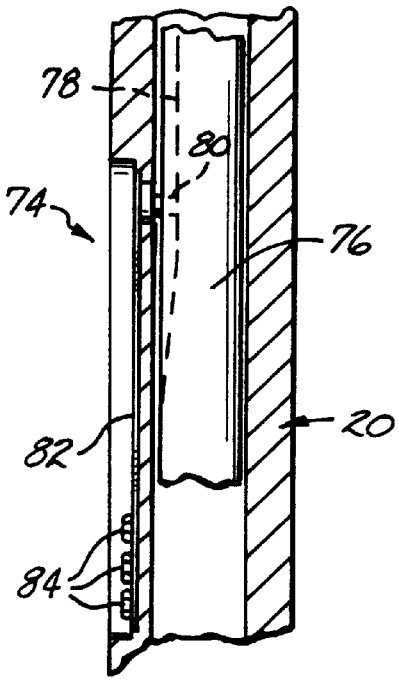
FIG. 4 is an enlarged partial cross-sectional view of the upper portion of the boring apparatus of FIG. 1.

Referring now to FIG. 4, there is illustrated a detent mechanism 74 operable between the shoe 20 and motor 24 to prevent the shoe 20 and motor 24 from rotating relative to one another. More particularly, intermediate the motor 24 and coupling 30 is a length of piping 76 which is rotatably fixed relative to the motor 24. This section of piping 76 includes a longitudinal running groove 78 therein. Cooperating with the groove 78 is a spring biased button 80 which is spring biased towards a radially inner position via leaf spring 82 secured by screws 84 to the shoe 20. Thus, when saw 46 and universal joints 40 are dropped downwardly into the shoe 20 and the saw 46 enters inlet 50 and passes into passageway 54, pipe 76 can then be twisted relative to the shoe 20 until the spring biased button 80 snaps into the groove 78 thereby operably rotationally locking the motor 25 relative to the shoe 20. If desired a spacer (not shown) can be inserted into the space 86 above the inlet 50 to adjust or limit the downward travel of the motor 24 and hence the lateral distance the hole saw 46 bores outwardly through the casing 12 and into the earth strata 14.

In use, the drill shoe 20 is lowered into the well casing 12 via pipe 21. Then liquid supply tube 28, collar 30, pipe 76, motor 24, universal joints 40 and hole saw 46 and drill bit 48 are lowered down through pipe 21 to drill shoe 20. Saw 46, drill bit 48 and universal joints 40 feed downwardly through the hollow drill shoe 20 and into inlet 50, through passageway 54 and to outlet 52. Then motor 24 is energized via fluid being pumped through tube 28 thereto to rotate output shaft 26 and hence universal joints 40, drill bit 48 and hole saw 46. Drill bit 48 begins boring a pilot hole through the wall of casing 12, thereby locating and stabilizing the hole saw 46. Hole saw 46 then proceeds to drill through the wall of the well casing 12. A distinct advantage of the hole saw 46 is that once the hole saw has drilled completely through the wall of the well casing 12 a plug of the well casing wall corresponding in diameter to the internal diameter of the hole saw 46 will be retained within the diameter of the hole saw 46. Thus, upon raising tube 28, coupling 30, pipe 76, motor 24, universal joints 40 and saw 46 and bit 48 up to the surface of the earth, one can readily and positively confirm that the well casing wall has in fact been completely bored through by observing the well casing wall plug within the internal diameter of the hole saw 46.

Once that fact has been confirmed, the tube 28, coupling 30, pipe 76, motor 24, universal joints 40 and saw 46 and bit 48 are withdrawn from the drill shoe 20 out pipe 21. Coupling 30, pipe 76, motor 24, universal joints 40 and saw 46 and bit 48 are removed from the supply tube 28 and a high pressure fluid nozzle (not shown) is connected to the supply tube 28. The supply tube 28 and the pressure nozzle attached thereto (not shown) are dropped down tube 21 and into the shoe 20 such that the nozzle passes into inlet 50, through passageway 54 and out outlet 52 into the earth strata. Thus separate flex cables and liquid supply tubes are not required as is in the apparatus of U.S. Pat. Nos. 5,413,184 and 5,853,056. The biasing element 70 insures that the outlet 52 remains aligned with the hole bored into the wall of the well casing 12 such that the high pressure fluid nozzle easily threads through outlet 52 through the well casing 12 wall and into the earth strata. Then fluid at high pressure is pumped to the high pressure nozzle to extend the channel bored into the earth strata 14 laterally outwardly relative to the longitudinal axis of the casing 12 the desired distance. In the event that casing 12 is vertical, the channel bored into the earth strata 14 will be of course horizontal.

Fluid motor 24 may be, for example, a water motor available from Danfoss of the Netherlands operable in response to 2000–5000 psi of water pressure and turning at about 300–500 rpm. Universal joints 40 may be, for example, ¾ inch universal joints no. 6445K6 available from McMaster-Carr of Atlanta, Georgia, modified by the assignee of the present invention to shorten the extensions thereof such that the distance between the pivot axes 60, 62 of adjacent ones of the universal joints 40 is about 1 ⅛ inches. Hole saw 46 may be, for example, a ¾ inch diameter hole saw no. 4066A14 available from McMaster-Carr modified by the assignee of the present invention to about ¾ inch in length. Drill bit 48 may be, for example, a ¼ inch drill bit no. 4066A66 available from McMaster-Carr modified by the assignee of the present invention to about ¾ inch in length (such that it extends beyond teeth of hole saw 46 about 3/16 inch).

Those skilled in the art will readily recognize numerous adaptations and modifications which can be made to the present invention which will result in an improved boring apparatus, yet all of which will fall within the spirit and scope of the present invention as defined in the following claims. For example, while the apparatus of the present invention has particular application to the oil and gas industry and the drilling of wells therefore, the invention has application to other arts wherein it is desired or required to bore a hole through the wall of a tube from the inside of the tube outwardly perpendicular to the longitudinal axis of the tube. And, while a water motor has been disclosed as the preferred motor for operating hole saw 46 and drill bit 48 other motors such as hydraulic or pneumatic motors could be utilized. Accordingly, the invention is to be limited only by the scope of the following claims and their equivalents.

What is claimed is:

1. Apparatus for boring a hole from an inside of a tube outwardly perpendicular to a longitudinal axis of the tube, said apparatus comprising:

a drill shoe having a longitudinal axis and being positionable in the tube, said shoe having an inlet, an outlet perpendicular to said shoe longitudinal axis and a passageway connecting said inlet and outlet;

a torsional load transmitting element having no torsional flexibility in relation to its bending flexibility, having a longitudinal axis and being disposed in said passageway, said torsional load transmitting element being movable relative to itself about first and second perpendicular axes both of which are perpendicular to said longitudinal axis of said torsional load transmitting element;

a hole saw connected to one end of said torsional load transmitting element; and a motor rotatably connected to the other end of said torsional load transmitting element;

whereby rotation of said torsional load transmitting element by said motor rotates said hole saw to bore through the tube from the inside of the tube outwardly perpendicular to the longitudinal axis of the tube.

2. The apparatus of claim 1 wherein said torsional load transmitting element is freely movable relative to itself about said first and second perpendicular axes.

3. The apparatus of claim 1 wherein said torsional load transmitting element is pivotable relative to itself about said first and second perpendicular axes.

4. The apparatus of claim 3 wherein said torsional load transmitting element is freely pivotable relative to itself about said first and second perpendicular axes.

5. The apparatus of claim 1 wherein said shoe inlet is parallel to said shoe longitudinal axis.

6. The apparatus of claim 1 further comprising a drill bit connected to said one end of said torsional load transmitting element centrally of said hole saw.

7. The apparatus of claim 1 further comprising a biasing element mounted to said shoe and adapted to bias said outlet of said shoe against the tube.

8. The apparatus of claim 1 further comprising a detent mechanism operable between said shoe and said motor to prevent said motor from rotating relative to said shoe.

9. The apparatus of claim 1 wherein said drill shoe is fabricated in halves.

10. Apparatus for boring a hole from an inside of a tube outwardly perpendicular to a longitudinal axis of the tube, said apparatus comprising:

a drill shoe having a longitudinal axis and being positionable in the tube, said shoe having an inlet, an outlet perpendicular to said shoe longitudinal axis and a passageway connecting said inlet and outlet;

a plurality of interconnected universal joints having a longitudinal axis and being disposed in said passageway, adjacent ones of said universal joints being pivotable relative to one another about first and second perpendicular axes both of which are perpendicular to said longitudinal axis of said plurality of interconnected universal joints;

a hole saw connected to one end of said plurality of interconnected universal joints; and a motor rotatably connected to the other end of said plurality of interconnected universal joints;

whereby rotation of said plurality of interconnected universal joints by said motor rotates said hole saw to bore through the tube from the inside of the tube outwardly perpendicular to the longitudinal axis of the tube.

11. The apparatus of claim 10 wherein said adjacent ones of said universal joints are pivotable at least about 35° relative to one another.

12. The apparatus of claim 10 wherein said shoe inlet is parallel to said shoe longitudinal axis.

13. The apparatus of claim 10 further comprising a drill bit connected to said one end of said plurality of universal joints centrally of said hole saw.

14. The apparatus of claim 10 further comprising a biasing element mounted to said shoe and adapted to bias said outlet of said shoe against the tube.

15. The apparatus of claim 10 further comprising a detent mechanism operable between said shoe and said motor to prevent said motor from rotating relative to said shoe.

16. The apparatus of claim 10 wherein said drill shoe is fabricated in halves.

17. The apparatus of either of claim 1 or 10 wherein the tube is a well casing.

18. The apparatus of claim 17 wherein the well casing is an oil well casing.

19. The apparatus of claim 17 wherein the well casing is a gas well casing.

* * * * *